US007193368B2

(12) United States Patent
Chen et al.

(10) Patent No.: US 7,193,368 B2
(45) Date of Patent: Mar. 20, 2007

(54) PARALLEL LAMPS WITH INSTANT PROGRAM START ELECTRONIC BALLAST

(75) Inventors: Timothy Chen, Aurora, OH (US); James K. Skully, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 10/987,472

(22) Filed: Nov. 12, 2004

(65) Prior Publication Data

US 2006/0103317 A1 May 18, 2006

(51) Int. Cl.

| | |
|---|---|
| ***H05B 39/00*** | (2006.01) |
| ***H05B 41/14*** | (2006.01) |
| ***H05B 39/04*** | (2006.01) |
| ***H05B 37/02*** | (2006.01) |

(52) U.S. Cl. ..... 315/95; 315/105; 315/106; 315/209 CD; 315/224

(58) Field of Classification Search ..... 315/94, 315/95, 105, 106, 107, 210, 224, 246, 291, 315/312, 324, 209 CD
See application file for complete search history.

(56) References Cited

U.S. PATENT DOCUMENTS

| | | | | |
|---|---|---|---|---|
| 5,170,099 | A * | 12/1992 | Ueoka et al. | 315/291 |
| 5,438,243 | A | 8/1995 | Kong | 315/219 |
| 5,512,801 | A | 4/1996 | Nilssen | 315/209 R |
| 5,731,667 | A | 3/1998 | Luchetta et al. | 315/323 |
| 5,744,915 | A | 4/1998 | Nilssen | 315/209 R |
| 5,834,906 | A | 11/1998 | Chou et al. | 315/307 |
| 5,877,592 | A * | 3/1999 | Hesterman et al. | 315/106 |
| 5,920,155 | A * | 7/1999 | Kanda et al. | 315/307 |
| 5,959,408 | A * | 9/1999 | Steel et al. | 315/106 |
| 5,982,113 | A | 11/1999 | Crouse et al. | 315/291 |
| 6,236,168 | B1 * | 5/2001 | Moisin | 315/291 |
| 6,366,031 | B2 * | 4/2002 | Klien | 315/291 |
| 6,809,477 | B2 | 10/2004 | Soules et al. | 315/219 |
| 2003/0160554 | A1 | 8/2003 | Soules et al. | 313/272 |
| 2004/0051475 | A1 | 3/2004 | Griffin | 315/291 |
| 2004/0070324 | A1 | 4/2004 | Lisitsyn | 313/271 |

* cited by examiner

*Primary Examiner*—Thuy Vinh Tran
(74) *Attorney, Agent, or Firm*—Fay Sharpe LLP

(57) ABSTRACT

In a current fed electronic ballast multiple lamps are operated in a parallel circuit arrangement. The ballast provides pre-heating to the cathodes of the lamps for a period of time before an open circuit voltage is ramped up to the preferred starting voltage of the lamps. An open circuit voltage controller times coordinates the pre-heating and the operating voltage. After the pre-heating phase, current is removed from the cathodes of the lamps so that electricity is not wasted to the cathodes while the lamps are lit. A single switch is used to switch cathode pre-heating on and off, regardless of how many lamps the ballast operates. A decoupling array of diodes allows the single switch to coordinate pre-heating to all the lamps.

27 Claims, 10 Drawing Sheets

PARALLEL LAMPS WITH INSTANT PROGRAM START ELECTRONIC BALLAST

BACKGROUND

Generally, there are two main types of fluorescent ballasts manufactured for low pressure, hot cathode discharge lamps. The first type is a hot start electronic ballast, also known as a program start electronic ballast. Typically, a program start electronic ballast provides a relatively low voltage across the lamp with a separate cathode heating current during lamp startup. Pre-heating the cathode before lamp ignition, lowers the amount of voltage needed to strike the lamp, that is, the glow discharge current is minimized. By minimizing the glow discharge current, the cathode life is extended since the amount of the cathode that is spattering off during lamp startup is minimized, extending the overall life of the lamp.

This type of lighting system finds particularly useful application in a setting where the lights are frequently turned on and off, such as in a conference room, a lavatory, or other setting that sees frequent but non-continuous usage. In these settings, light is needed when the room is in use, but typically the lights are turned off to save energy when no one is using the room. In short, the program start electronic ballast is beneficial for applications in which the lamps undergo a high number of on/off cycles.

Despite its advantages, the program start electronic ballast does have drawbacks. First, because it has to pre-heat the cathode before it strikes the lamp, there is a noticeable delay from the time when the light switch is activated to the time when the lamp emits visible light. Typically this delay is on the order of 1.5 seconds. This delay is therefore a drawback in settings where a user expects an almost instantaneous lighting of an area.

Another drawback of the program start ballast is that once the lamp is lit, current is still provided to heat the cathodes when it is no longer needed. This current may consume up to 3 to 5 watts of power per lamp, which can be up to 10% of some systems' operating power. This current is wasted, as it neither provides extra light, nor extends the life of the lamp. This waste of power after the lamp is lit makes the system less efficient overall.

Additionally, program start lamp ballasts commonly utilize a series lamp configuration. In a series configuration, if one lamp fails, it will shut down the circuit for the whole ballast, causing all lamps in the ballast to be turned off. Thus, the lamps in the ballast produce no light where they could be producing light from other lamps if the lamps were in a parallel configuration. Since all lamps will not be producing light, more frequent servicing of the lighting installation will be required, increasing the cost of labor to maintain the system.

One additional concern is that most program start ballasts are required to have IC driven control. This type of control adds to the cost of the ballast.

The second common type of ballast, the instant start ballast, addresses some issues of the program start ballast, however, it introduces some new issues of its own. Typically, an instant start ballast does not pre-heat the cathodes, rather it applies the operating voltage directly to the lamp. In this design, at the moment the switch is turned on, a high voltage is provided across the lamp. For a typical system the voltage can be about 600 V, and the peak voltage can be up to about 1000 V. With this high voltage across the lamp, sufficient glow current exists to bring the lamp up to a point where the lamp will ignite quickly. The lamp, therefore, has a much shorter ignition time (typically about 0.1 seconds) as compared to the program start systems, and light is seen substantially concurrently with the activation of the light switch. Also, there is no extra current drain to the cathodes during operation, since the operating voltage is applied directly to the lamp cathodes. Instant start ballasts also use parallel lamp configurations with inherently built-in redundancy in the event of the lamp failure.

However, the instant start ballast produces a glow discharge current, which degrades the integrity of the cathodes during the brief period before the lamp strikes. Over time, with instant starts, the cathodes degrade at a rate, leading to an early failure of the lamp.

Thus, a drawback of the instant start ballast is premature lamp failure. Because an instant start ballast burns through cathodes so quickly, lamps may fail long before their expected lifetimes.

While the program start ballasts are inefficient because they waste power, the instant start ballasts are inefficient because they may require more lamps for a given amount of time. Consequently, it is desirable to take the advantages of the beneficial aspects of the program start ballast (e.g. longer lamp life) and combine them with the advantages of the instant start ballast (e.g. quick start time) to produce an improved lamp ballast. The present application contemplates a method and apparatus that combines the positive aspects of the program start and instant start ballasts without propagating the negative aspects of those ballasts.

BRIEF DESCRIPTION

According to one aspect of the present application, an electronic ballast is provided. The ballast includes an inverter that converts a DC bus voltage into an AC signal for powering at least one lamp during a preheat phase. A cathode current controller provides a preheat current to the at least one lamp. An open circuit voltage controller provides a lamp firing voltage to the at least one lamp after the preheating phase.

According to another aspect of the present application, a method of lamp operation is provided. An AC line voltage is received, regulated, and converted into a DC bus signal. The DC bus signal is then converted back into an AC signal for operation of lamps. A preheat current is provided to cathodes of the lamps. The preheat current is redirected and combined with another current to ignite the lamps.

According to another aspect of the present application, an electronic ballast is provided. An inverter converts a DC bus voltage into an AC lamp operating signal. A cathode current controlling ballast capacitor system regulates a preheat current to at least two lamps. First and second diode pairs decouple the first and second lamps from each other, respectively.

DETAILED DESCRIPTION

Figure 1:
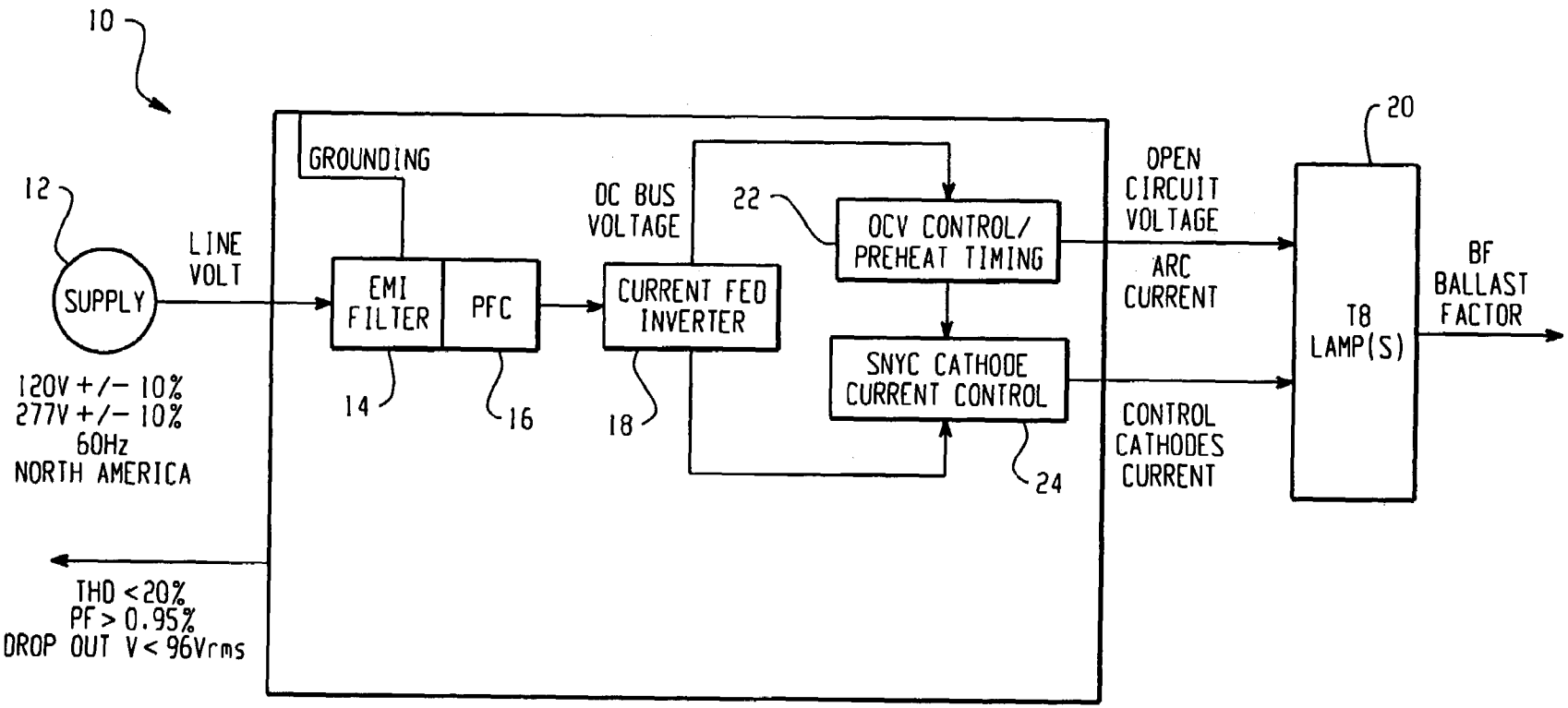
FIG. 1 is a block diagram illustration of a ballast in accordance with the present application.

With reference to FIG. 1, a block diagram of one embodiment of a lamp ballast 10 according to the present application is depicted. A voltage supply 12 provides an AC signal to the ballast 10. The voltage supply 12 can provide a wide range of input voltages, such as 120 V, or 277 V, as is typical for the United States. The line voltage signal is filtered by an EMI filter 14 and then is converted from AC to a DC bus signal by a power factor correction circuit (PFC) 16. The power factor correction circuit 16 supplies the DC bus signal to an inverter circuit 18, which may be a current fed inverter and which generates an AC signal for the powering of lamps 20. This design permits a parallel lamp arrangement without multiple inverters or multiple ballasts. In certain embodiments the power factor correction circuit 16 will make the ballast input line current distortion low, for example, less than 10% for a 120 volt input and less than 20% for a 277 volt input. It is to be appreciated, inverter circuit 18 may be any appropriate inverter circuit including half-bridge current fed invertors, and current fed push-pull invertors, where such invertors are represented by inverter circuit 18.

Before power is passed to a lamp or set of lamps 20 by the inverter 18, it is first gated by an open circuit voltage (OCV) controller 22. The controller 22 times how long a pre-heat current should be applied to cathodes of the lamps 20, and passes that information to a cathode current controller 24. More specifically, in one embodiment the open circuit voltage controller 22 will control the voltage to the lamp to be less than about 300 V peak across each lamp 20 during the pre-heat phase. During this time, the cathode current controller 24 applies the pre-heat current to lamps 20 before the operating voltage is applied to the lamps 20 to ignite and operate the lamps in steady-state. The pre-heating phase lasts approximately 0.3 to 0.5 seconds, after which the cathode current controller 24 switches off current to the cathodes of the lamps 20. Next, the open circuit voltage controller 22 will shift up the voltage to ignite the lamp or lamps. In this embodiment, once the voltage across the lamps 20 reaches a range of 450 to 600 V RMS, and more approximately 475 V RMS, the lamps 20 strike and start emitting light. It is to be appreciated that the open circuit voltage controller 22 and cathode current controller 24 may each be one of integrated circuit controllers as well as controllers designed as discrete component circuits. The OCV controller 22 is designed as a buffer and decoupling arrangement or circuit whereby the lamps of the system are isolated from each other, so each lamp works independently. The power factor correction circuit 16, in this embodiment, may be an active power factor correction circuit which is able to accept a wide range of input voltages.

Thus, the embodiment of FIG. 1, as will be explained in greater detail below, illustrates a circuit which uses a current fed based parallel lamp ballast topology. The cathode's current is controlled to a maximum level to quickly bring the cathode temperature up to a thermionic emitting temperature, or Rh/Rc>5, where Rh/Rc is the ratio of the final heated or hot cathode resistance (Rh) to the cold cathode resistance (Rc) at 25° C. In addition, the design of FIG. 1, and the more detailed figures to follow, shows a design which incorporates a cathode voltage shorting circuit, which completely removes the external cathode heating after lamp ignition, increasing the lamp life, and providing a higher system efficiency and low cost in a single design package. The described lighting system will also retain the high quality and reliability of typical instant start systems.

Figure 2:
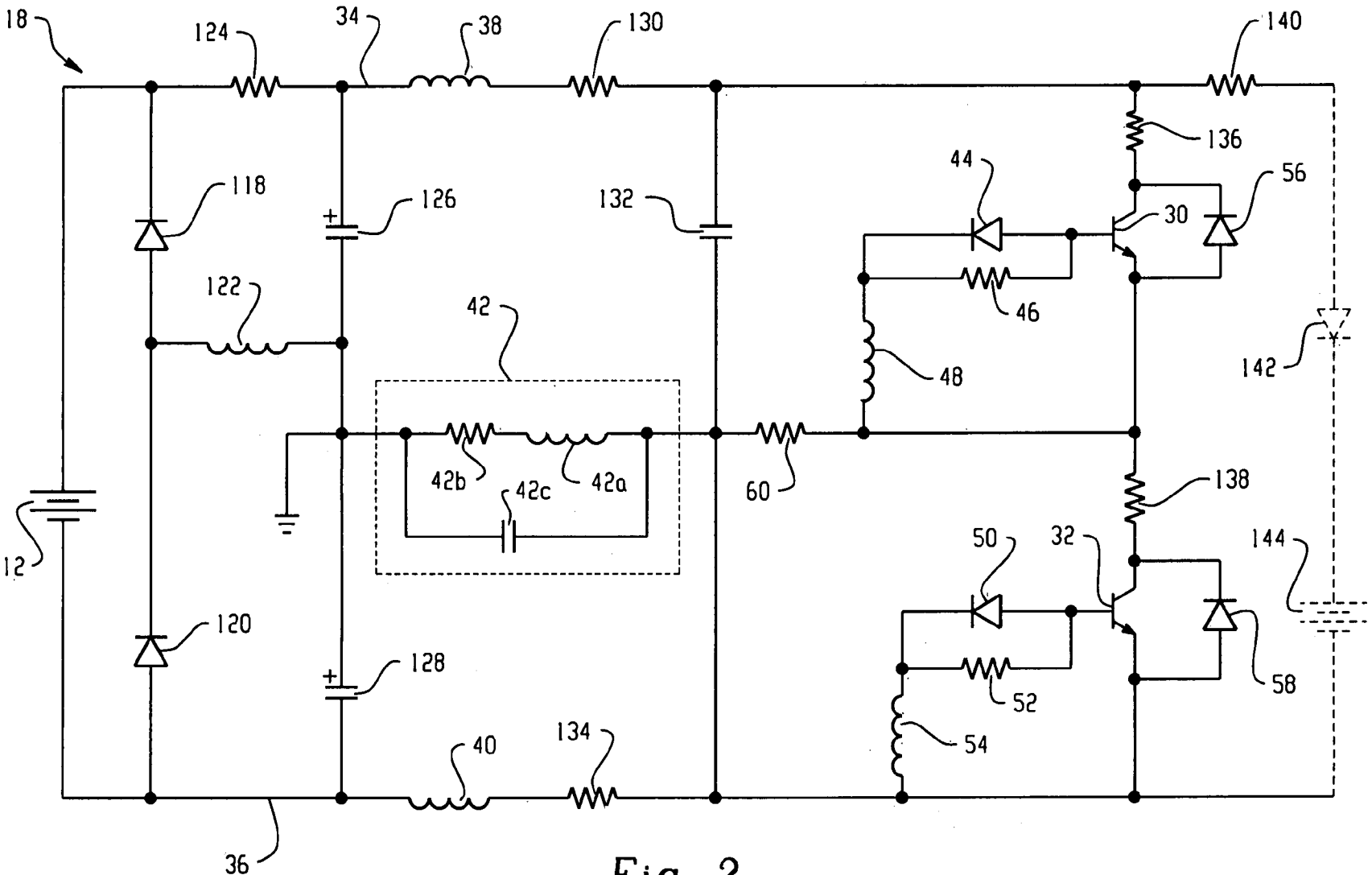
FIG. 2 is a circuit diagram of an inverter circuit of the ballast of FIG. 1.
Figure 3:
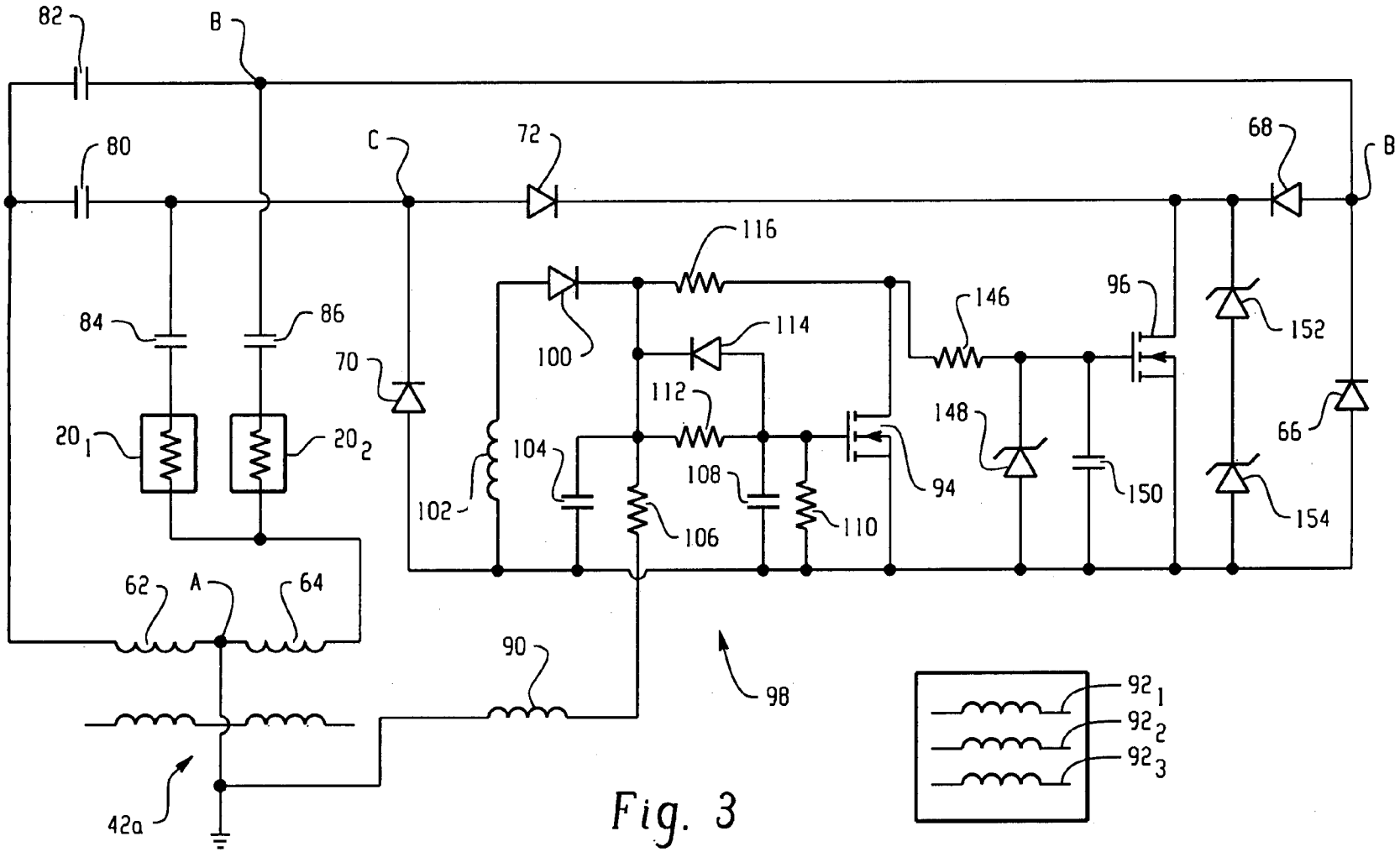
FIG. 3 is a circuit diagram of the open circuit voltage control and the cathode current control for FIG. 1.

Turning now to FIGS. 2 and 3, a more detailed circuit diagram of one embodiment of inverter 18 (FIG. 2) and open circuit voltage controller 22 and cathode current controller 24 (both FIG. 3) are provided. FIG. 2 shows inverter 18, which is based on a half bridge current fed circuit topology, includes transistor switches 30,32, which alternate periods of conductivity. That is when transistor 30 is conductive, transistor 32 is non-conductive, and vice versa. The transistors 30, 32 are preferably bipolar junction transistors (BJTs), but is to be understood that field effect transistors (FETs) or other appropriate switching device are also contemplated. Generally, the transistors 30, 32 are connected in series between a positive or upper bus rail 34 and a negative or lower bus rail 36, via the current transformer configured by inductors 38 and 40. The current transformers of inductors 38, 40 are provided for current limiting. The inductors 38, 40 allow transistors 30, 32 to see a substantially DC signal with a small amount of AC ripple. Inductor 38 is located on the positive bus rail 34, and inductor 40 is located on the negative bus rail 36. RLC circuit 42 (which includes inductor 42*a*, resistor 42*b*, and capacitor 42*c*) is used to define the resonant frequency of the ballast 18. Inductor 42*a* is the primary of a power transformer that supplies power to the open circuit voltage controller 22 and the cathode current controller 24 of FIG. 1 which are shown in more detail in FIG. 3. Transistor switches 30 and 32 are driven by known driving circuitry such as illustrated in FIG. 2, including diode 44, resistor 46 and inductor 48 arrangement to drive transistor switch 30, and a diode 50, resistor 52 and inductor 54 driving transistor switch 32. It is also noted that transistor switch 30 has a connected parallel diode 56 and transistor switch 32 is shown with a connected parallel diode 58. A resistor 60 is shown to represent the equivalent copper resistance that is connected between series connected transistor switch 30 and 32 to the resonant circuit 42.

The power transformer having primary inductor 42*a* also includes secondary inductors 62 and 64 (FIG. 3) coupled to the primary inductor 42*a*. Inductor 64 provides lamp operating power to the lamps $\mathbf{20}_1$, $\mathbf{20}_2$, but during the pre-heat phase, the FET 96 is turned on so the voltage that the lamps see during the pre-heat phase is reduced. When the pre-heat phase ends, the FET 96 is turned off and the voltage is ramped up to ignite the lamps $\mathbf{20}_1$ and $\mathbf{20}_2$. At the same time, inductor 62 draws power from primary inductor 42*a* to provide pre-heating to the cathodes of lamps $\mathbf{20}_1$, $\mathbf{20}_2$. In one embodiment, inductor 64 will have less than 50% total secondary voltage. For example, in one instance, inductor 64 may develop approximately 45% of the voltage and inductor 62 draws approximately 55% of the voltage. Other ratios have also been contemplated, but the mentioned ratio is adequate to keep the pre-heat voltage low to reduce the glow discharge current to be less than 10 ma with peak voltage across lamp <300V.

A reason the secondary winding is split into two secondary windings 62 and 64, is to permit the configuration of the circuit so the first winding 62 may be bypassed, and therefore only the second half of the winding voltage (i.e., from winding 64) and voltage on the inductor 90 will be applied to the lamps. Thus allowing for the reduced voltage across the lamps mentioned above.

The voltage from winding 62 will go through several diodes, including diodes 66, 68, 70 and 72. These diodes are interconnected to upper capacitors 80, 82, 84 and 86. The diode and capacitor arrangement provides a buffering, decoupling operation which permits each individual lamp to be operated separately without interference due to the removal or delamping or failure of other lamps in the system when the individual lamp is at steady state. A more detailed discussion of these diode and capacitor arrangements will be discussed in detail in following figures.

Current from secondary inductor 62 also charges cathode pre-heating primary inductor 90. The inductor 90 transfers power to cathode pre-heating secondary inductors $\mathbf{92}_1$, $\mathbf{92}_2$, $\mathbf{92}_3$. It is to be understood that while cathode preheating windings $\mathbf{92}_1$, $\mathbf{92}_2$, $\mathbf{92}_3$ are shown separated out in FIG. 3, these windings are connected to the lamps in a known manner. For example, one winding is providing two lamp cathodes in parallel and the other two are connected to each individual lamp.

With continuing reference to FIGS. 2 and 3, transistor 94 is connected to the gate of transistor 96. The transistor 94 is gated by the timing circuit 98. Timing circuit 96 is configured to an optimal pre-heat time (about 0.3 to 0.5 seconds) to time the striking of the lamp. Once the timing circuit 98 is charged, the gate voltage is reduced down to approximately 0.3V to transistor 96 to turn it non-conductive, removing the pre-heat current from the lamps $\mathbf{20}_1$, $\mathbf{20}_2$.

A timing circuit 98 may be configured in a variety of designs, including in this embodiment component diode 100, inductor 102, capacitor 104 in parallel with resistor 106, capacitor 108 and resistor 110. Additionally, resistor 112 is placed in parallel with diode 114, and a resistor 116 connects diode 100 to transistor 94. These components are arranged as timing circuit 98 to feed transistor 94, which as mentioned is connected to the gate of transistor 96.

Returning attention to FIG. 2, diodes 118', 120', and inductor 122' form a voltage clamp. If one of the lamps $\mathbf{20}_1$, $\mathbf{20}_2$ should be removed from the ballast 10 or otherwise fails, the remaining lamp will still see the same voltage because of the voltage clamp during the preheating phase.

There are further components shown in FIGS. 2–3 that were not specifically called out previously. These components 124–154 are typical for modem lighting ballasts and their functions are known to those skilled in the art.

Figure 4:
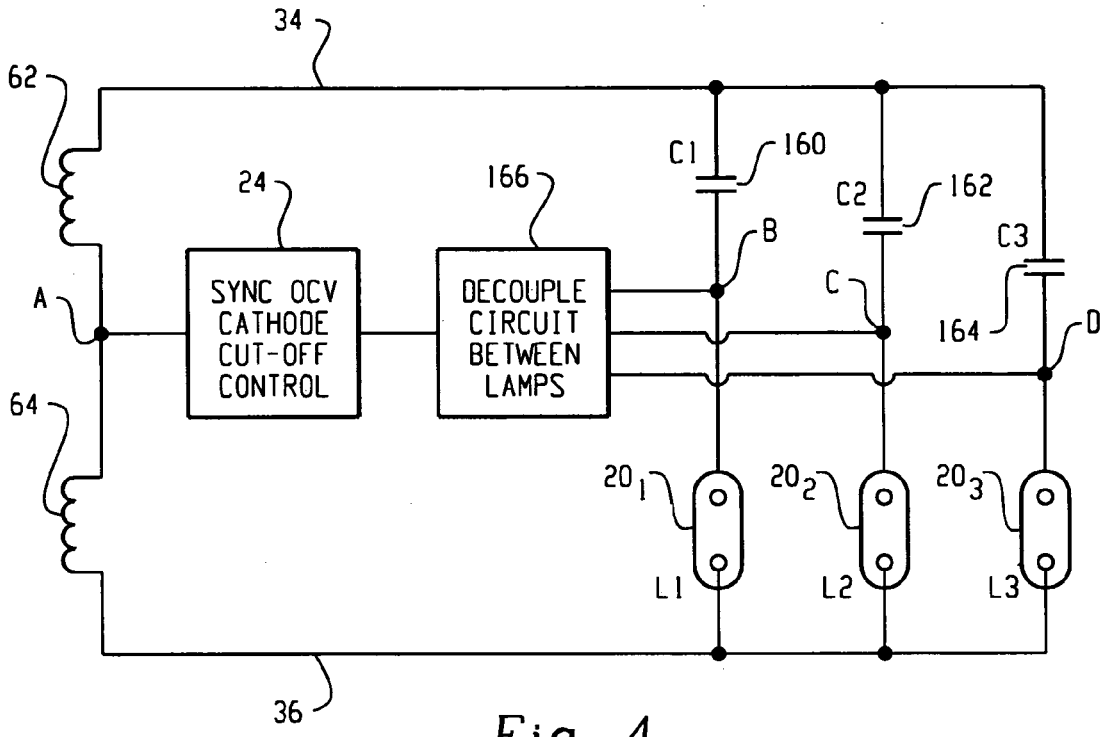
FIG. 4 is a simplified depiction of a circuit performing functions of FIG. 3, arranged as a bi-level primary path single capacitor group system circuit.

It is to be appreciated the output control scheme of FIG. 3 which includes the mentioned capacitor and diode networks, is one embodiment of a circuit which is configured to selectively buffer, decouple and isolate the lamps in a lighting system. The following figures set forth further embodiments which are also provide these functions. Particularly, FIG. 4 represents a simplified version of one embodiment of a bi-level primary path single capacitor circuit voltage control scheme for the present application. Capacitors 160, 162, and 164 collectively form a ballast capacitor system. Each lamp 20 is connected to one of the capacitors 160, 162, 164 in the ballast capacitor system. Only three capacitors 160, 162, 164 and lamps $\mathbf{20}_1$, $\mathbf{20}_2$, $\mathbf{20}_3$ are shown in FIG. 4, but it is to be understood that for each of the embodiments any number (more or less) of lamps could be operated by the ballast 10. Additional lamps can be added in parallel with their own capacitor adding to the ballast capacitor system. The ballast capacitor system is present whether the lamps are operational or not. Therefore, when a lamp is rendered inoperative, the remaining lamps still see the same operating voltage, e.g. approximately 475 V RMS through capacitors 160, 162 or 164. If the ballast capacitor system is not present there will be no means to limit the lamp current at the lamps and the ballast will fail.

Each capacitor 160, 162, 164 in the ballast capacitor system operates as a buffer during startup of the lamp. Regardless of when each lamp fires (if they do not fire precisely concurrently), unlit lamps still see the same voltage, e.g., approximately 475V RMS. That is, the ballast capacitor system keeps the firing voltage to unlit lamps from interfering with lighting of other lamps. Additionally, to keep the voltage down to the preferred preheat voltage value low, a decoupling array 166 shorts points A, B, C, and D together during the pre-heat phase. In this manner, the lamps $\mathbf{20}_1$, $\mathbf{20}_2$, $\mathbf{20}_3$ are not exposed to the full voltage supplied by both secondary windings 62, 64, but rather they only see the voltage supplied by winding 64. Thus the lamps do not undergo the phenomenon of glow discharge because the voltage across the lamps is held to a safe level.

In FIG. 4, decoupling array or network 166 shorts the points A, B, C, and D the moment a user activates a light switch. After the pre-heat period, (approximately 0.3 to 0.5 seconds) the cathode current controller 24 switches open the current path from inductor 62 from the cathode preheating operation , boosting the voltage used to strike the lamps. In this manner, the cathode pre-heat current is not wasted after the lamp ignites, because it is no longer providing preheating current to cathode heating transformers 98, $\mathbf{92}_1$, $\mathbf{92}_2$, $\mathbf{92}_3$ to the lamp cathodes.

Figure 5:
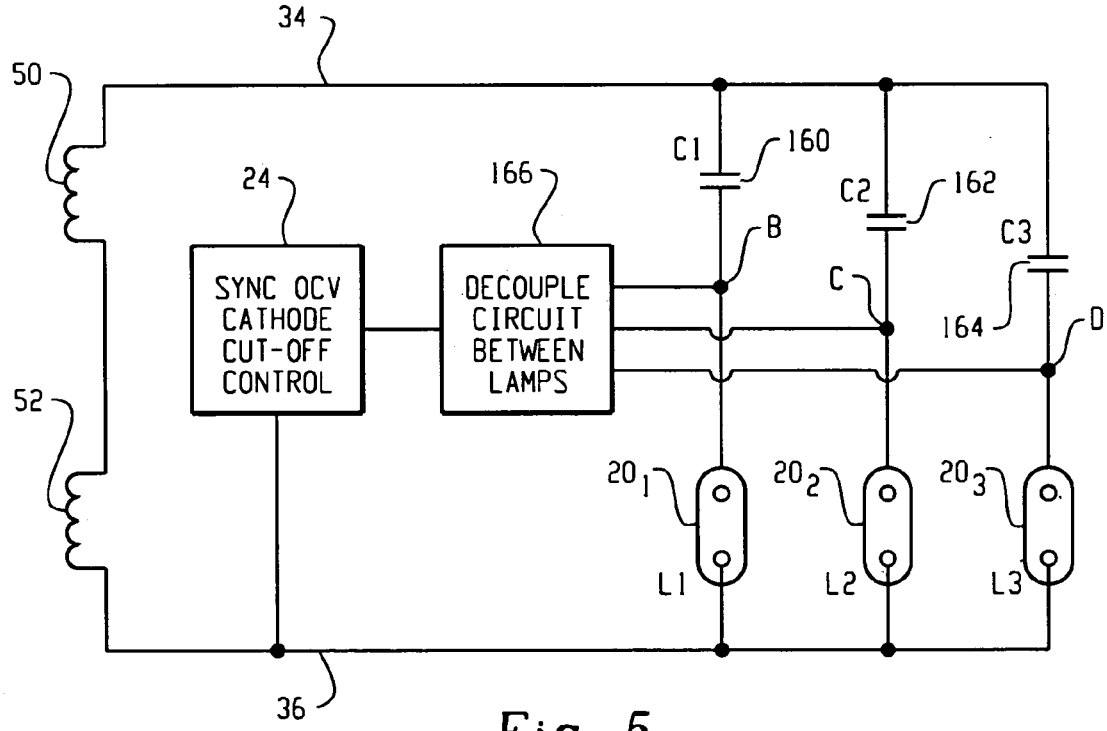
FIG. 5 is a simplified depiction of a circuit performing functions of FIG. 3, arranged as a one-level primary path single capacitor group system circuit.

Turning to FIG. 5, illustrated is a generalized figure, similar to FIG. 4. However, whereas the cathode cut-off control block 24 in FIG. 4 is connected to point A, creating a bi-level primary path single capacitor circuit, FIG. 5 has the cathode cutoff controller 24 connected to the lower rail 36. In this design, therefore, the voltage across both of inductors 62 and 64 are provided to the cathode cutoff controller 24.

Figure 6:
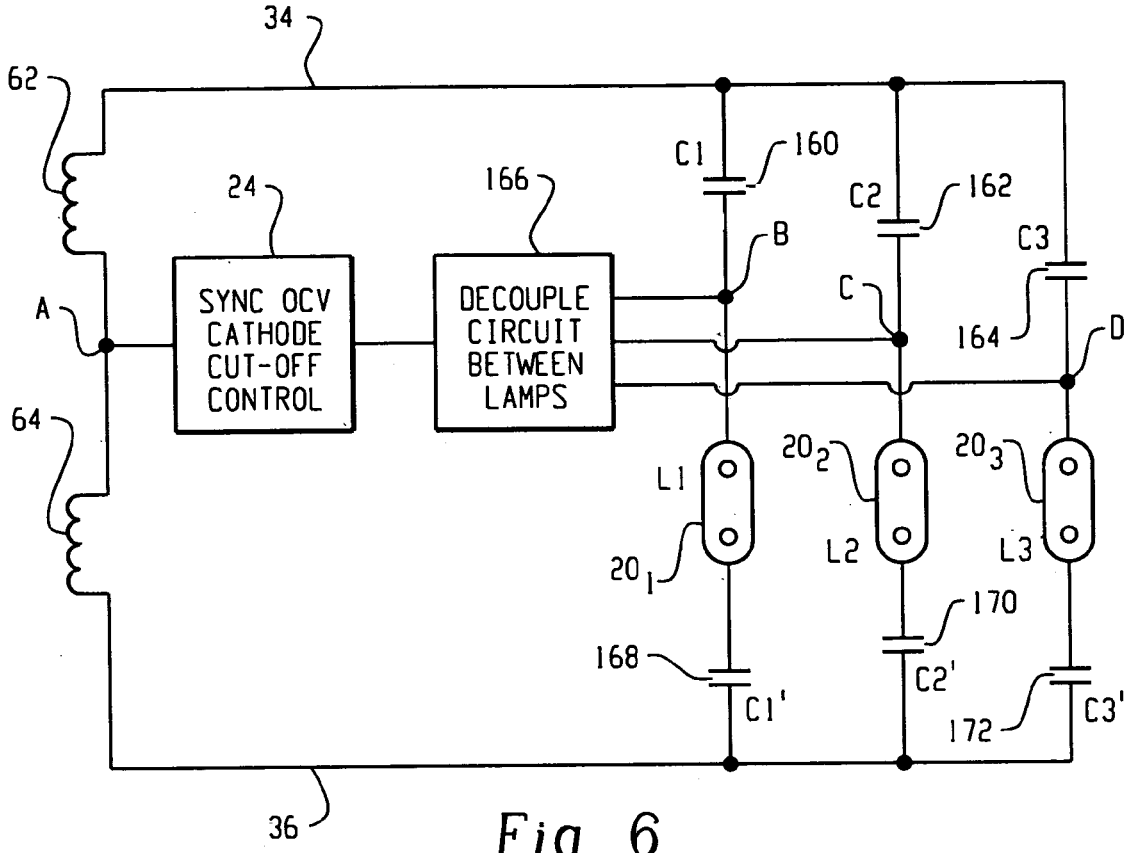
FIG. 6 is a simplified depiction of a circuit performing functions of FIG. 3, arranged as a bi-level primary path two-capacitor group system circuit.

FIG. 6, similar to FIGS. 4 and 5, provides a generalized design of an output control circuit, which in this case is a bi-level primary path two-capacitor control circuit. Particularly, in the circuit of FIG. 6, the cathode cutoff control block 24 is connected again to point A between inductors 62 and 64. However, distinguishing this circuit from FIG. 4, an additional capacitor block including capacitors 168, 170, 172 is added between lamps $\mathbf{20}_1$, $\mathbf{20}_2$ and $\mathbf{20}_3$ and lower rail 36. In this design, capacitors 160, 162 and 164, along with capacitors 168, 170, 172, are in series with respective lamps $\mathbf{20}_1$, $\mathbf{20}_2$, $\mathbf{20}_3$. By this arrangement, a further degree of freedom in the design of the circuit is achieved. In particular, in FIGS. 4 and 5 where a single capacitor system is used, the primary function of the capacitors is to provide a sufficient amount of current to the cathode. However, these capacitors may also be selected to control the lamp during normal operating current. However, in FIG. 6, and also as will be shown in FIG. 7, through the use of two-capacitor group systems, it is possible to target the two tasks individually instead of trying to address the two tasks in a single capacitor system. For example, in one embodiment, selection of capacitors 160, 162 and 164 may be used to control the preheat provided to the cathodes, and capacitors 168, 170 and 172 may be selected for the best control of lamp current. It is to be appreciated the arrangement of components in FIG. 3 is also a bi-level two-capacitor network. Thus, each of the described ballast systems assists in the regulation of at least one of current to the lamp cathodes and a steady state operating current.

Figure 7:
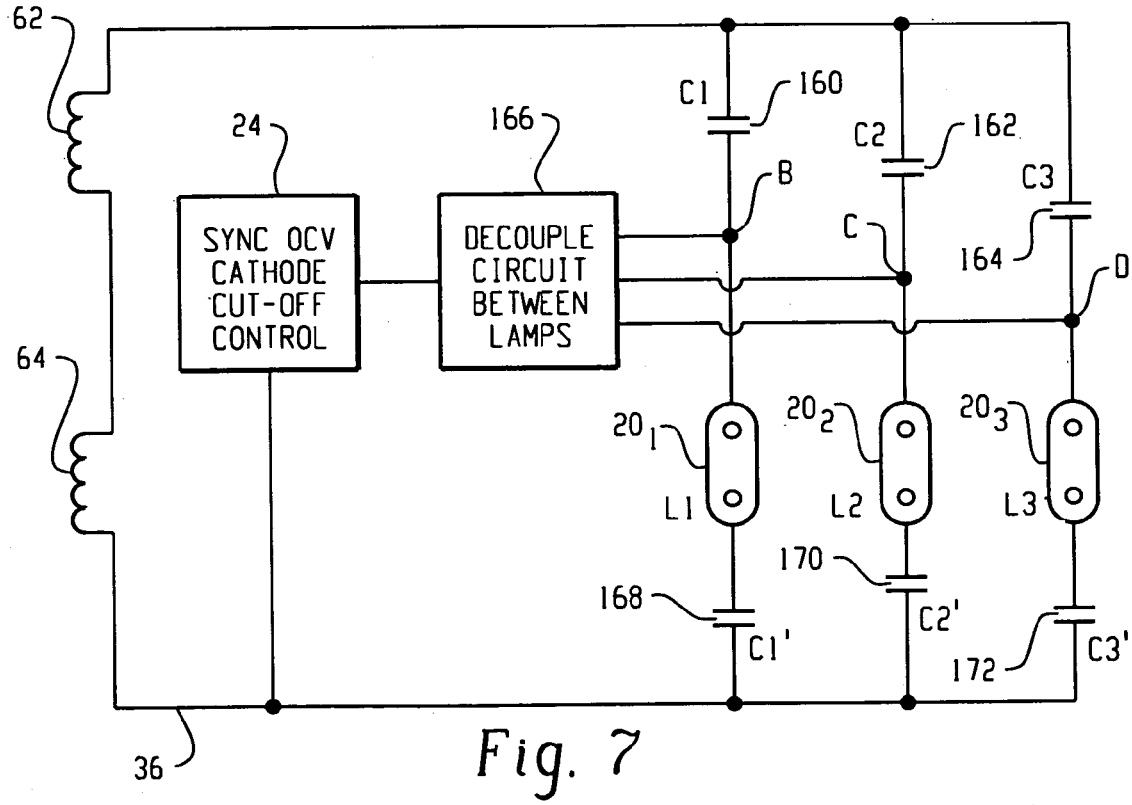
FIG. 7 is a simplified depiction of a circuit performing functions of FIG. 3, arranged as a one-level primary path two-capacitor group system circuit.

Turning to FIG. 7, provided is a one-level primary path two-capacitor system circuit. Particularly, the cathode cutoff control block 24 is connected to the lower bus 36 as provided in FIG. 5, whereby the total voltage of windings 62 and 64 is provided, and a dual capacitor system is selected as shown, for example, in connection with FIG. 6. Thus, similar to FIG. 6, a greater degree of freedom in designing and selecting component values for optimal control of the circuit may be achieved.

Figure 8:
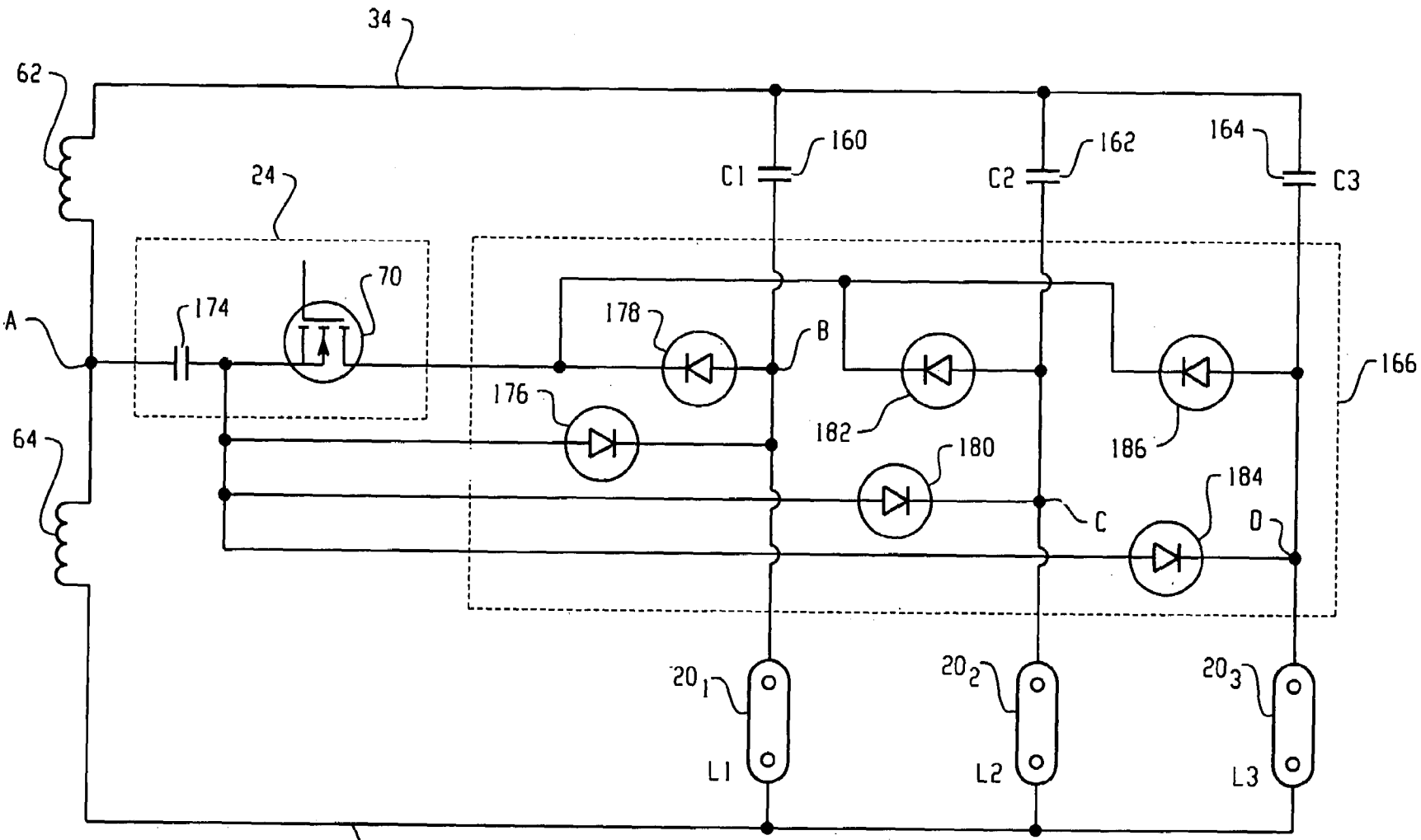
FIG. 8 illustrates an output control circuit, emphasizing specific component relationships of a bi-level primary path single capacitor group system circuit.

The diagram of FIG. 4 is depicted in more detail in FIG. 8. The cathode current controller 24 is shown to include a switch 70 (see FIG. 3) that controls the cathode pre heating and a system capacitor 174. In the preferred embodiment, each lamp 20 has a current control network (e.g., a diode network) embodied here as two decoupling diodes. As depicted in FIG. 8, lamp 20, is associated with diodes 176 and 178, lamp 202 is associated with diodes 180 and 182, and lamp 203 is associated with diodes 184 and 186. Diodes 176–186 are part of the decoupling array 166. When switch 70 is conductive, it shorts points B, C, and D together and via cap 174 to A, as previously discussed. When switch 70 is conductive, bi-directional current can flow from point A through diode 176, (past point B) on a first half cycle and through diode 178, FET 70 and back to point A. Thus, when switch 70 is conductive, points A and B are essentially the same point in the circuit, i.e., they are shorted(assuming that capacitor 174 has low AC impedance). Similarly, when switch 70 is conductive, current can flow from point A through diode 180, (past point C) through diode 182 and back to point A, essentially shorting points C and A together. A conductive switch 70, diode 184 and diode 186 short points D and A together in a similar fashion. The circuit topology shown in FIG. 8 is easily expandable to accommodate more lamps. To expand the decoupling array 166, each additional lamp may be accompanied by two additional diodes. It is to be understood, the current control network may employ components other than diodes, as long as the components achieve the desired decoupling operations.

When the switch 70 is non-conductive, the path back to point A from points B, C, and D through diodes 178, 182 and 186, respectively, is opened. Current flow in the opposite direction is prevented by diodes 176, 180 and 184 due to the peak charge on capacitors 160, 162, 164. Thus, the cathode pre-heating is removed when switch 70 opens. The switch 70 and decoupling array 166 ensure that uniform cathode heating is being applied to the parallel arrangement of lamps. The decoupling array allows a parallel relationship to exist without complex timing and switching for each parallel lamp.

Figure 9:
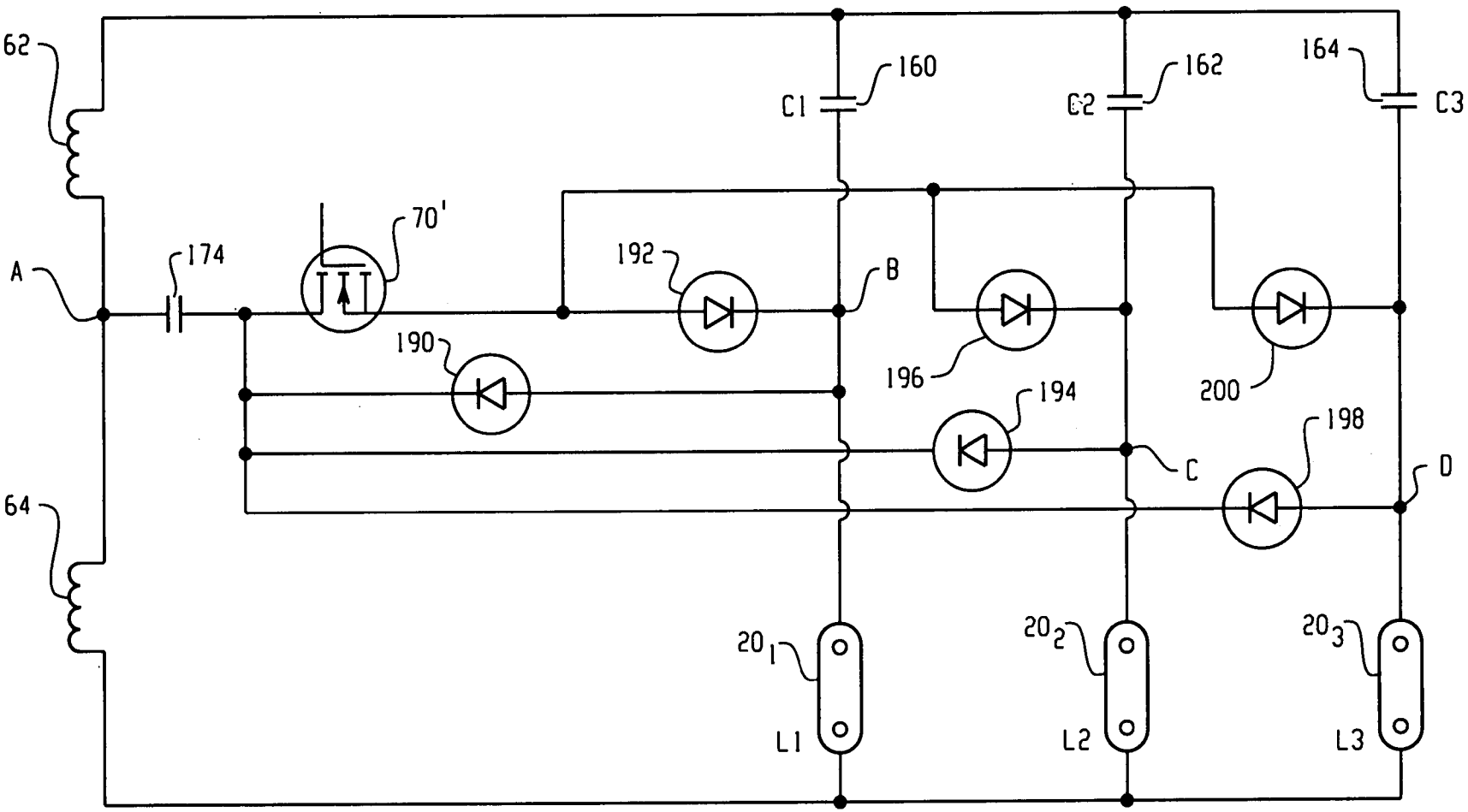
FIG. 9 depicts an output control circuit emphasizing specific component relationships of a one-level primary path single capacitor group system circuit.

In an alternate embodiment, illustrated in FIG. 9, diodes 190, 192, 194, 196, 198 and 200 have reversed polarity from diodes 176–186. Thus when switch 70' is conductive, current flows in the opposite direction through the switch. The circuit is otherwise akin to the circuit depicted in FIG. 8.

Figure 10:
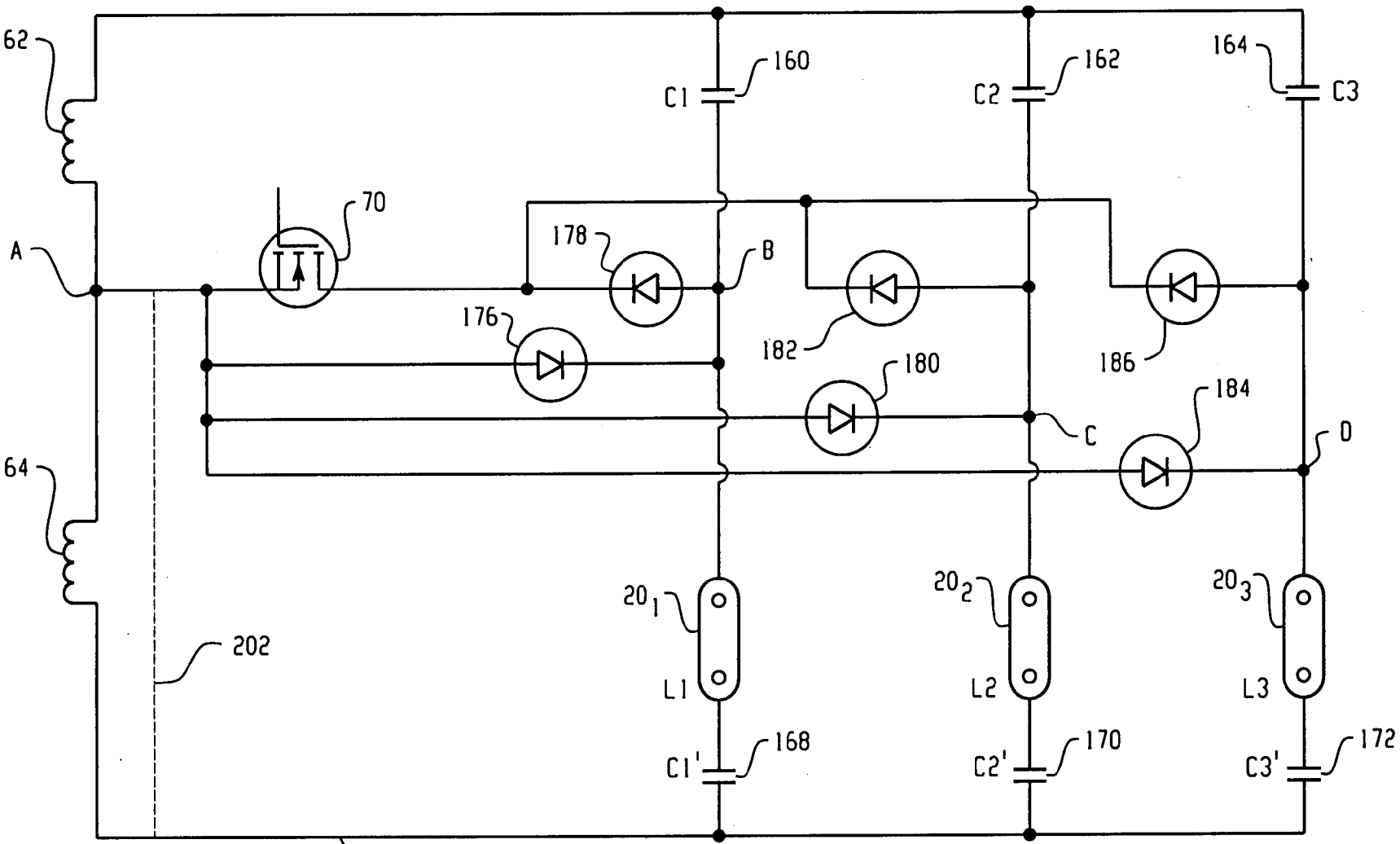
FIG. 10 depicts an output control circuit emphasizing specific component relationships of a bi-level primary path two-capacitor group system circuit.

In another alternate embodiment, as depicted in FIG. 10, additional ballast capacitor system 20 is added to the circuit of FIG. 8. The second ballast capacitor system of capacitors 168, 170, 172 can share the tasks of the first ballast capacitor system, such as controlling the open circuit voltage and regulating the cathode preheating current. The addition of a second ballast capacitor system provides more versatility, as tasks can be shared between the two ballast capacitor systems. Dotted line 202 is provided to emphasize that these embodiments may have a connection point between windings 62, 64 or to the lower bus 36.

Figure 11:
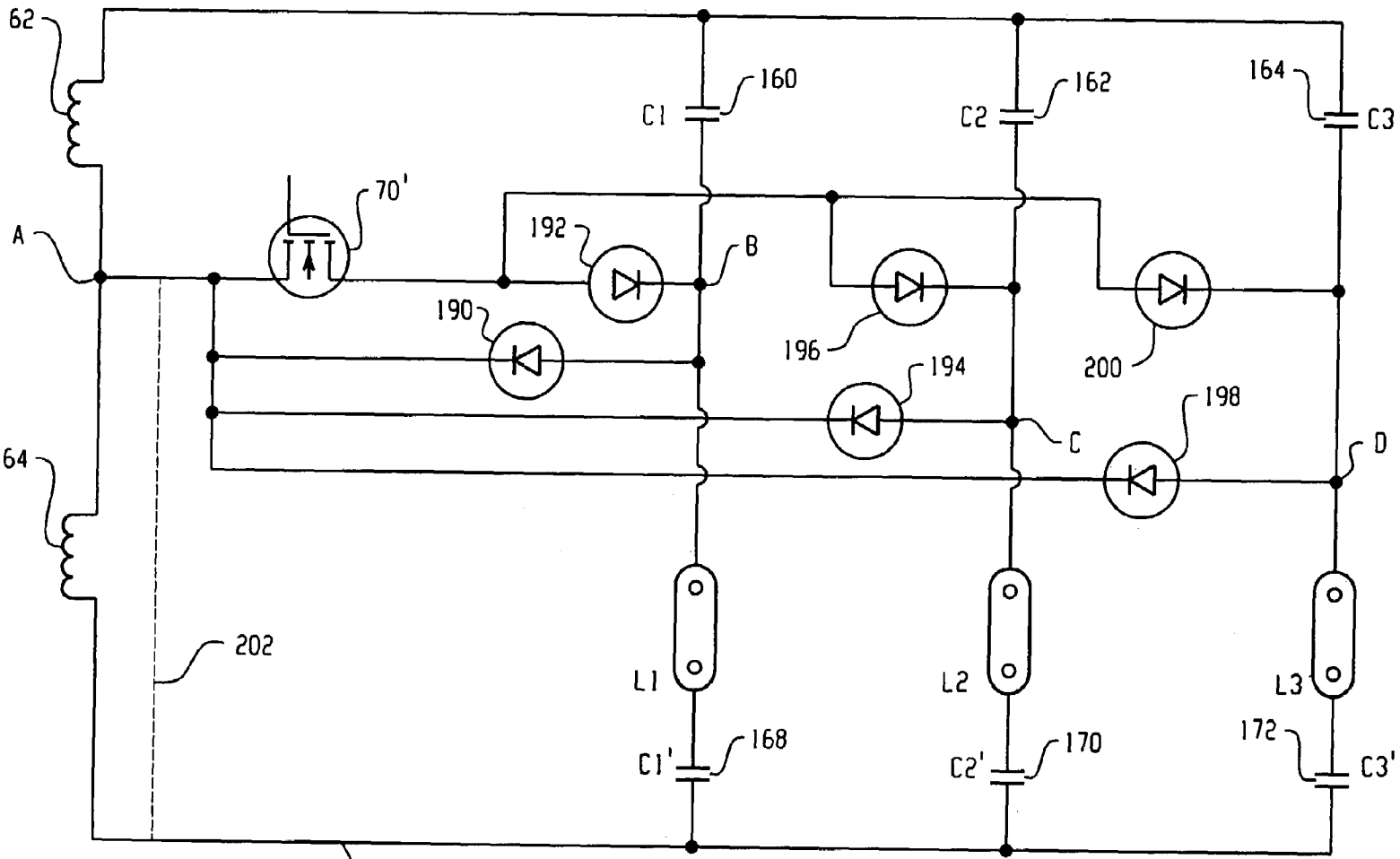
FIG. 11 illustrates an output control circuit emphasizing specific components relationships of a one-level primary path two-capacitor group system circuit.

In still another alternate embodiment, as shown in FIG. 11, the diodes of FIG. 10 have reversed polarity. Thus, when switch 70 is conductive, current flows in the opposite direction through the switch. The circuit is otherwise akin to the circuit depicted in FIG. 10.

While the above concepts may be implemented in a number of designs, the following component values may be used in at least one embodiment:

| | |
|---|---|
| Transistor 30 | BUL1102E |
| Transistor 32 | BUL1102E |
| Inductor 38 | 4.4 mh |
| Inductor 40 | 4.4 mh |
| Inductor 42a | 920 μh |
| Inductor 42c | 0.012 μf |
| Diodes 44, 50 | D1N5817 |
| Resistors 46, 52 | 75 Ω |
| Inductors 48, 54 | 0.45 μh |
| Inductor 62 | 0.6 mh |
| Inductor 64 | 0.5 mh |
| Diodes 66, 68, 70, 72 | UF4007 |
| Capacitors 80, 82 | 4.7 nf |
| Capacitors 84, 86 | 2.2 nf |
| Inductor 90 | 0.8 mh |
| Transistor 94, 96 | FQU2N100 |
| Diode 100 | D1N4148 |
| Inductor 102 | 0.6 mh |
| Capacitor 104 | 0.47 μf |
| Resistor 106 | 10k |
| Capacitor 108 | 33 μf |
| Resistor 110 | 1000k |
| Resistor 112 | 1000k |
| Diode 114 | D1N4148 |
| Resistor 116 | 10k |
| Diode 118 | UF4007 |
| Diode 120 | UF4007 |
| Inductor 122 | 2 mh |
| Capacitor 126 | 47 μf |
| Capacitor 128 | 47 μf |
| Voltage Source 144 | 1000 V |
| Resistor 146 | 10 Ω |
| Zener Diode 148 | 2 V |
| Capacitor 150 | 1 nf |
| Diode 152 | 440 V |
| Diode 154 | 440 V |

Figure 12:
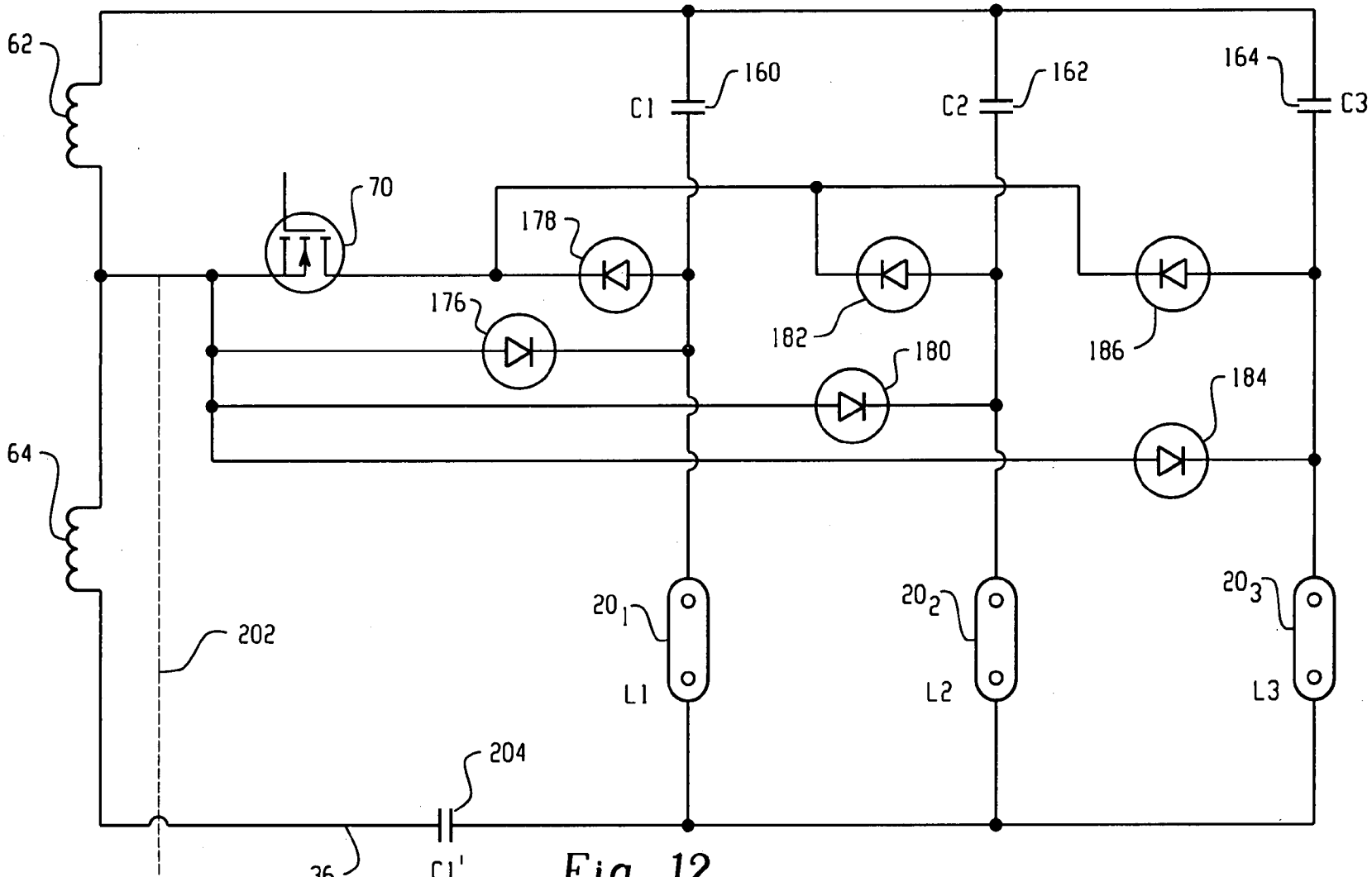
FIG. 12 depicts an output control circuit emphasizing specific component relationships of a bi-level primary path two-capacitor group system circuit.

An additional alternate embodiment, shown in FIG. 12, combines the two previous alternate embodiments. That is, it adds a second ballast capacitor system which, however, is comprised of a single capacitor for the entire system. This design is slightly less versatile than the systems with a capacitor for each lamp, but it is less expensive to implement.

The above concepts have been described with reference to the preferred embodiments. Obviously, modifications and alterations will occur to others upon reading and understanding the preceding detailed description. It is intended that the description be construed as including all such modifications and alterations.

What is claimed is:

1. A ballast for powering at least one lamp of a plurality of lamps comprising:

an inverter connected to receive a DC bus voltage, and to convert the DC bus voltage into an AC signal for powering the at least one lamp of the plurality of lamps;

a cathode current controller configured to provide a preheat current to the at least one lamp of the plurality of lamps; and an open circuit voltage controller that reduces the preheat current, and increases a voltage to be provided as a lamp firing voltage to the at least one lamp of the plurality of lamps;

an output stage configured to connect the at least one lamp of the plurality of lamps; and a buffer and decouple arrangement wherein the buffer and decouple arrangement is configured to permit each individual lamp of the plurality of lamps to be operated separately without interference from other lamps of the plurality of lamps.

2. The ballast as set forth in claim 1, wherein the buffer and decouple arrangement is a bi-level primary path, single capacitor group system circuit.

3. The ballast as set forth in claim 1, wherein the buffer and decouple arrangement is a one-level primary path single capacitor group system circuit.

4. The ballast as set forth in claim 1, wherein the buffer and decouple arrangement is a bi-level primary path two-capacitor group system circuit.

5. The ballast as set forth in claim 1, wherein the buffer and decouple arrangement is a one-level primary path two-capacitor group system circuit.

6. The ballast as set forth in claim 1, wherein the buffer and decouple arrangement is a single-level primary path, two-capacitor group system circuit, wherein the two-capacitor group system includes a first capacitor group having a plurality of capacitors and a second capacitor group having a single capacitor.

7. The ballast as set forth in claim 1, wherein the buffer and decouple arrangement is a bi-level primary path, two-capacitor group system circuit, wherein the two-capacitor group system includes a first capacitor group includes a plurality of capacitors and a second capacitor group having a single capacitor.

8. The ballast as set forth in claim 1, wherein the inverter is a half-bridge current fed inverter.

9. The ballast as set forth in claim 1, wherein the inverter is a push-pull current fed inverter.

10. The ballast as set forth in claim 1, wherein the cathode current controller provides the preheat current for a time in a range of approximately 0.3 seconds to 0.5 seconds.

11. The ballast as set forth in claim 1, wherein the cathode current controller provides the preheat current for approximately 0.3 seconds.

12. The ballast as set forth in claim 1, wherein the lamp firing voltage is approximately less than 500 V RMS and greater than 450 V RMS.

13. The ballast as set forth in claim 1, wherein the lamp firing voltage is approximately 475 V RMS.

14. The ballast as set forth in claim 1, wherein the open circuit voltage controller includes the buffer and decouple arrangement.

15. The ballast as set forth in claim 1, wherein the cathode current controller and the open circuit voltage controller are configured to operate in synchronization with each other.

16. A ballast for powering at least one lamp of a plurality of lamps comprising:

an inverter connected to receive a DC bus voltage, and to convert the DC bus voltage into an AC signal for powering the at least one lamp of the plurality of lamps;

a cathode current controller configured to provide a preheat current to the at least one lamp of the plurality of lamps; and an open circuit voltage controller that reduces the preheat current, and increases a voltage to be provided as a lamp firing voltage to the at least one lamp of the plurality of lamps;

a first ballast capacitor system comprising at least one capacitor that regulates at least one of:

(i) current to the cathode of the at least one lamp of the plurality of lamps; and (ii) a steady state operating current to the at least one lamp of the plurality of lamps.

17. The ballast as set forth in claim 16, further including:

a second ballast capacitor system for regulating at least one of:

(i) current to the cathode of the at least one lamp of the plurality of lamps; and (ii) steady state operating current to the at least one lamp of the plurality of lamps.

18. The ballast as set forth in claim 17, further including:

a diode network associated with each capacitor in the first ballast capacitor system for decoupling the at least one lamp of the plurality of lamps controlled by the ballast.

19. The ballast as set forth in claim 16, wherein the cathode current controller and the open circuit voltage controller are configured to operate in synchronization with each other.

20. A ballast for powering at least one lamp of a plurality of lamps comprising:

an inverter connected to receive a DC bus voltage, and to convert the DC bus voltage into an AC signal for powering the at least one lamp of the plurality of lamps;

a cathode current controller configured to provide a preheat current to the at least one lamp of the plurality of lamps; and an open circuit voltage controller that reduces the preheat current, and increases a voltage to be provided as a lamp firing voltage to the at least one lamp of the plurality of lamps;

a first inductor that serves as a bus break on an upper bus; and a second inductor that serves as a bus break on a lower bus.

21. A method of operating lamps in a lamp lighting system comprising:

smoothing an upper DC bus voltage with a first inductor;

smoothing a lower DC bus voltage with a second inductor;

converting the DC bus voltages into an AC lamp operating signal;

providing a preheat current to cathodes of lamps of the plurality of lamps to be ignited;

reducing the preheat current; and providing a lamp firing voltage to the lamps of the plurality of lamps.

22. The method as set forth in claim 21, further including: providing a steady state operating current after providing the lamp firing voltage.

23. A method of operating lamps in a lamp lighting system comprising:

converting a DC bus voltage into an AC lamp operating signal;

providing a preheat current to cathodes of lamps of the plurality of lamps to be ignited;

reducing the preheat current;

providing a lamp firing voltage to the lamps of the plurality of lamps; and regulating current to the lamp cathodes with a first ballast capacitor system.

24. The method as set forth in claim 23, further including:

regulating a steady state operating voltage with one of the first ballast capacitor system and a second ballast capacitor system.

25. A method of operating lamps in a lamp lighting system comprising:

converting a DC bus voltage into an AC lamp operating signal;

providing a preheat current to cathodes of lamps of the plurality of lamps to be ignited;

reducing the preheat current;

providing a lamp firing voltage to the lamps of the plurality of lamps; and decoupling the lamps from one another by selectively clamping the lamps with an associated diode network.

26. A lamp lighting circuit comprising:

an output stage configured to hold a plurality of lamps;

a buffer stage configured to buffer lamps of the plurality of lamps held in the output stage from receiving undesirable voltages; and a decouple stage configured to decouple operation of the plurality of lamps of the output stage from each other, wherein each individual lamp of the plurality of lamps is capable of being operated separately without interference from other lamps, wherein the decouple stage includes:

a first diode network for decoupling a first of the lamps from the other lamp of the output stage; and a second diode network for decoupling a second of the lamps from other lamps of the output stage.

27. The electronic ballast as set forth in claim 26, further including:

a current controlling ballast capacitor system for regulating a steady state operating current to the first of the plurality of lamps and the second of the plurality of lamps.

* * * * *